US007252451B2

(12) United States Patent
Jiang et al.

(10) Patent No.: US 7,252,451 B2
(45) Date of Patent: Aug. 7, 2007

(54) AUTOMATIC ADJUSTMENT AND CONTROL STRUCTURE FOR WRITING LIQUID

(76) Inventors: Hongfan Jiang, Room 04, 2/F, No. 18, Lane 211, Baotun Road, Shanghai (CN); Shu Wai Chong, Room 212, Mountaintop Garden, Dapu, Hong Kong (HK)

( * ) Notice: Subject to any disclaimer, the term of this patent is extended or adjusted under 35 U.S.C. 154(b) by 0 days.

(21) Appl. No.: 11/290,385

(22) Filed: Nov. 30, 2005

(65) Prior Publication Data

US 2007/0122229 A1 May 31, 2007

(51) Int. Cl.
*B43K 5/00* (2006.01)

(52) U.S. Cl. ..... 401/199; 401/198

(58) Field of Classification Search ..... 401/196, 401/198, 199

See application file for complete search history.

(56) References Cited

U.S. PATENT DOCUMENTS 3,113,336 A * 12/1963 Arvid ..... 401/206
4,336,767 A * 6/1982 Wada ..... 118/264
6,416,242 B1 * 7/2002 Kaufmann ..... 401/198
6,503,017 B1 * 1/2003 Liu ..... 401/199

* cited by examiner

*Primary Examiner*—David J. Walczak
(74) *Attorney, Agent, or Firm*—Hamre, Schumann, Mueller & Larson, P.C.

(57) ABSTRACT

An automatic adjustment and control structure for writing liquid comprising a storage of writing liquid (1), an adjustment portion (2), an automatic adjustment and control element (3), a writing tip (4) and a guiding wick (5), wherein said automatic adjustment and control element is fixed within said adjustment portion and seals said storage of writing liquid, said adjustment portion defines an air aperture (21), one end of said guiding wick is deeply inserted into said automatic adjustment and control element and the other end is joined with said writing tip. The whole structure is very simple and the main performance thereof has advanced over high-class writing utensils and it is very fit for various types, purposes and classes of writing utensils.

15 Claims, 1 Drawing Sheet

AUTOMATIC ADJUSTMENT AND CONTROL STRUCTURE FOR WRITING LIQUID

BACKGROUND OF THE INVENTION

1. Field of the Invention

The present invention relates to a structure of a writing utensil, and more especially to an automatic adjustment and control structure for writing liquid which enlarges the capability of storage, strengthens the ability of anti-leakage and improves the utility.

2. Description of the Prior Art

Currently there are certain drawbacks in traditional writing utensils, such as leakage, unsmooth writing, poor capability and short useful life. Additionally the writing liquid often has not been substantially utilized. However, all of these have brought users so much inconvenience. By research people discover that the key factor resulting in the drawbacks above-mentioned is ill structure of writing utensils. These drawbacks could not be overcome unless the structure has been improved.

Present writing utensils throughout the world including fountain pens, ball pens, roller pens, markers, and so on have three main types on the basis of structure, though their variety and function are quite different.

One type is a filter structure used widely which depends on a roll-shaped fibrous means to absorb, store and supply the writing liquid. However, it has stored finite writing liquid and has poor utilization ratio that is only about 60 percent, which results in short useful life. In addition, when writing since the writing liquid reduced gradually the writing liquid has been pulled by a force directed from the writing tip, while it has also been absorbed by a force caused by the roll-shaped fibrous means. The two forces are converse so as to induce unsmooth writing. Moreover, it is prone to leak when the roll-shaped fibrous means is full of writing liquid.

Another type is a storage structure usually applied on fountain pens. This structure adopts a special sheet-shaped storage to control the supply of writing liquid and prevent from leakage. Unfortunately, the whole structure is very complicated and requires to be molded integrally. The design, manufacture, craft and precision thereof are substantially technical. Additionally, the channels for air and writing liquid are both tiny and single, so once any one of them has been blocked, the use of the whole writing utensil will be influenced unavoidably. Its shape and capability would be restricted for its function and posture.

Still another type is by utilizing a "floating lid", which belongs to the field of ball pens. The "float lid" is liquid which controls flow of air and the writing liquid. This structure has poor capability because it has been technically restricted by the diameter of the storage hole. The flow of writing liquid is easily affected by shake and temperature. At present this structure is only used in ball pens and gel pens.

These years some new structures have occurred, such as "spring valve", "glove valve" and a combination of a filter structure and a storage. But some of them have uneven flow of writing liquid during use and then it often requires pressing the writing tip, so these writing utensils can not write continuously. During the air pressure changed or the ambient temperature rose, causing the air within the writing utensils to expand, since the valves do not have function of self-adjustment, when pressing the writing tip again, writing liquid is easily to burst forth. The convey line of other structures is the common single channel for both air and writing liquid, upon that the flow out of writing liquid and the inflation of air are performed in a same channel but from converse directions, which has effect on the pass in and out of air and writing liquid. Moreover, the outlet of the convey line is located below the capillary storage, so the overflowed writing liquid by air expansion reaches the bottom of the capillary storage first and then in stock, thereby affecting the capability and air exhaust of the capillary storage. If the air within the writing utensil expands again, its practical function would be dropped off remarkably.

Although structures of writing utensils are improved to a certain extent, some so-called new structures are more complicated rather than overcome the known drawbacks, but also bring a lot of new trouble. These new structures are not accepted and recognized by people seems that improvement of structures is not easy and simple.

Generally, the present structures of writing utensils could not escape from the former pattern. The drawbacks deriving from ill structures come down historically, but the research and development to structures are really lagged, especially at the times that the society and science advance rapidly.

BRIEF SUMMARY OF THE INVENTION

A primary object of the present invention is to provide an automatic adjustment and control structure for writing liquid which has large capability so as to overcome drawbacks of leakage, complication and poor capability.

To achieve the above-mentioned object, an automatic adjustment and control structure for writing liquid in accordance with a preferred embodiment of the present invention is disclosed. An automatic adjustment and control structure for writing liquid comprises a storage of writing liquid, an adjustment portion, an automatic adjustment and control element, a writing tip and a guiding wick, wherein said automatic adjustment and control element is fixed within said adjustment portion and seals said storage of writing liquid, said adjustment portion defines an air aperture, one end of said guiding wick is deeply inserted into said automatic adjustment and control element and the other end is joined with said writing tip.

Another embodiment of the automatic adjustment and control structure for writing liquid has a writing holder and a writing head engaging with the writing holder, wherein an automatic adjustment and control element having a plurality of capillarity is fixed within the writing holder, an air aperture is defined in which the writing holder is adjacent to the writing head, and the writing head is deeply inserted into the automatic adjustment and control element.

In accordance with the present invention, the cavity of the writing utensil serves as a storage of writing liquid so that the capability has been greatly enlarged and the useful life has been prolonged; the automatic adjustment and control element has functions of supply, control, adjustment and circulation of air and writing liquid; the circulation of air and writing liquid is very smoothly which has replaced the prior single channel; the abrasion of writing tip has been enormously reduced; the ability for anti-leakage is the supreme level among writing utensils and can be determined according to various requirements; the application range is widely extended to develop more new types of writing utensils; the automatic adjustment and control element can balance the pressure of internal writing liquid and air. The whole structure is very simple and the main performance thereof has advanced over high-class writing utensils and it is very fit for various types, purposes and classes of writing utensils.

BRIEF DESCRIPTION OF THE DRAWINGS

Other objects, advantages and novel features of the present invention will become more apparent from the following detailed description when taken in conjunction with the accompanying drawings, in which.

DETAILED DESCRIPTION OF THE INVENTION

Figure 1:
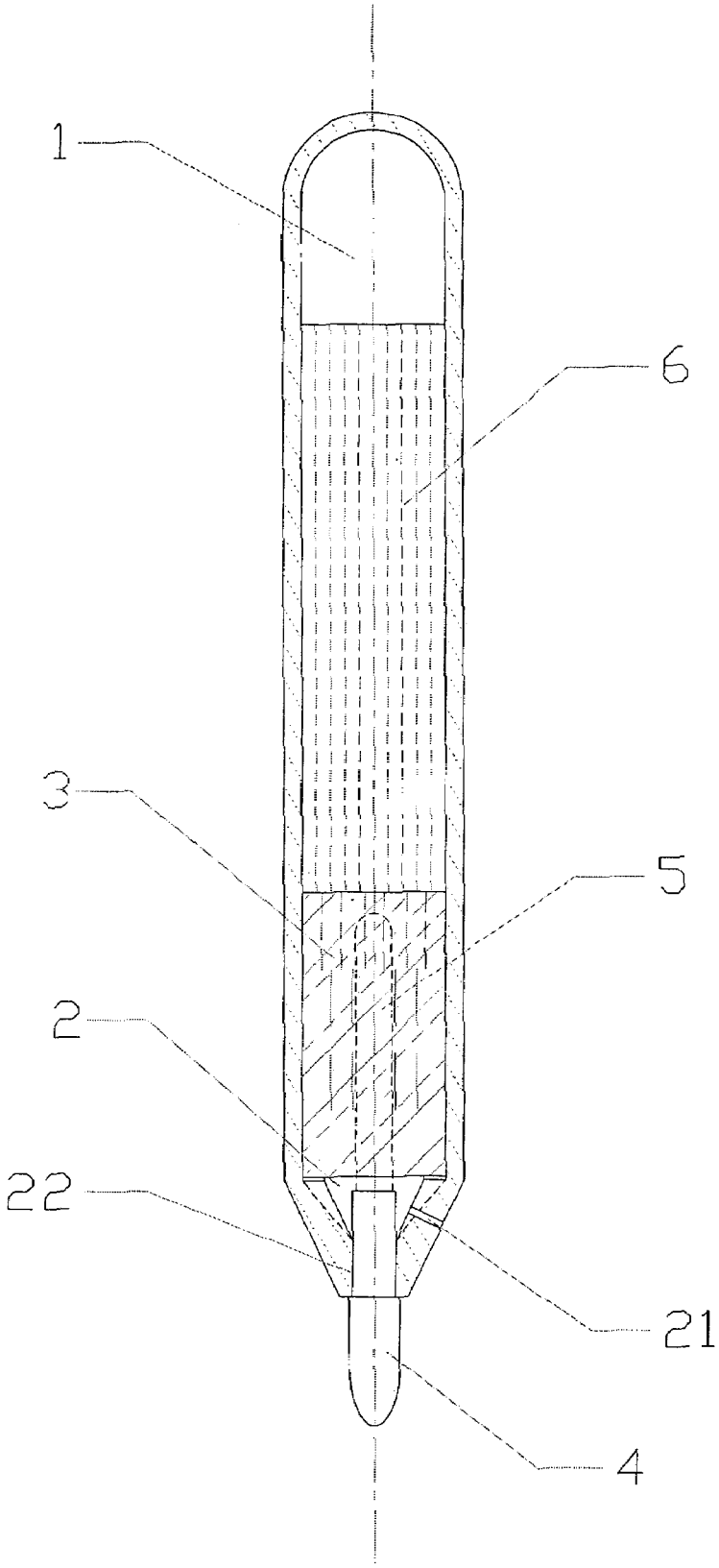
FIG. 1 is a cross-sectional view of an automatic adjustment and control structure for writing liquid in accordance with the present invention.

Referring to FIG. 1, an automatic adjustment and control structure for writing liquid in accordance with a preferred embodiment of the present invention includes a storage of writing liquid 1, an adjustment portion 2, an automatic adjustment and control element 3, a writing tip 4, and a guiding wick 5.

The storage of writing liquid 1 is a hollow tube for storing writing liquid 6. The adjustment portion 2 forms an air aperture 21 in front thereof. The automatic adjustment and control element 3 is fixed within the adjustment portion 2 and seals the storage of writing liquid 1. During practice certain amount of writing liquid 6 is input into the storage 1. The automatic adjustment and control element 3 is made of fibrous materials having good adsorbability and permeability. The automatic adjustment and control element 3 can be made as a whole or a combination. The capillarity within the automatic adjustment and control element 3 is designed according to various requirements of various writing utensils and conditions of manufacture. Its performance is embodied by the capillarity of various hierarchies or tiny holes which depends on consistency of materials and variation of hierarchies. The difference of capillarity among various hierarchies is achieved by materials continued with crafts. In this embodiment the capillarity within the automatic adjustment and control element 3 is degressively determined from one end of the automatic adjustment and control element 3 adjacent to the storage of writing liquid 1 to the relative end thereof to provide a plurality of channels for air or the writing liquid to pass through. One end of the guiding wick 5 is deeply inserted into the automatic adjustment and control element 3 and the other end is joined with the writing tip 4. The writing tip 4 and guiding wick 5 can be integrated together. In the front of the adjustment portion 2 there defines a mounting hole 22 for fixing the writing tip 4 when assembly.

In normal use, writing liquid 6 within the storage of writing liquid 1 is supplied to the writing tip 4 directly from the automatic adjustment and control element 3 via the guiding wick 5. When writing liquid 6 is partly consumed during writing, external air will flow into the automatic adjustment and control element 3 through the air aperture 21 for complementarity, or further makes the storage of writing liquid 1 obtain necessary air supplement. Normally the structure in accordance with the present invention is in a still balance state. If the air pressure changes or the ambient temperature rises to cause the air and writing liquid 6 within the storage of writing liquid 1 expanding, the automatic adjustment and control element 3 has functions of storing writing liquid 6 overflowed and letting air out so as to prevent from leakage. The writing liquid 6 stored in the automatic adjustment and control element 3 will return to the storage of writing liquid 1 along with resumption of air pressure and ambient temperature. The writing liquid 6 stored in the storage of writing liquid 1 will complement the automatic adjustment and control element 3 with consumption of writing.

It should be understood that the automatic adjustment and control structure for writing liquid in accordance with the present invention can be made as a separate structure, that is, the storage of writing liquid 1 as a separate unit (called unit 1), the adjustment portion 2, the automatic adjustment and control element 3, the writing tip 4 and the guiding wick 5 totally as the other separate unit (called unit 2). It can be used by engaging the unit 1 and unit 2. It only requires replacing a new storage of writing liquid 1 or complementing writing liquid 6 for use continuously once the stored writing liquid 6 is exhausted.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An automatic adjustment and control structure for writing liquid comprising:

a storage of writing liquid, an adjustment portion defining an air aperture in the front thereof, an automatic adjustment and control element made of fibrous materials having good adsorbability and permeability being fixed within said adjustment portion, a writing tip, and a guiding wick, wherein said automatic adjustment and control element serves as a partition between said storage of writing liquid and said adjustment portion, and has a degressive capillarity distribution from a first end of said automatic adjustment and control element adjacent to said storage of writing liquid relative to a second end adjacent to said writing tip, and wherein one end of said guiding wick is deeply inserted into but not through said automatic adjustment and control element and the other end is joined with said writing tip.

2. The automatic adjustment and control structure for writing liquid as claimed in claim 1, wherein said automatic adjustment and control element is a whole or a combination, which has tiny holes or a degressive hierarchy of capillarity distribution.

3. The automatic adjustment and control structure for writing liquid as claimed in claim 1, wherein said automatic adjustment and control element has a plurality of channels for air or the writing liquid to pass through.

4. The automatic adjustment and control structure for writing liquid as claimed in claim 1, wherein said writing tip and guiding wick can be integrated together.

5. The automatic adjustment and control structure for writing liquid as claimed in claim 1, wherein a mounting hole for fixing said writing tip when assembly is defined in the front of said adjustment portion.

6. An automatic adjustment and control structure for writing liquid comprising:

a writing holder including a storage of writing liquid and an adjustment portion; and a writing head engaging with said writing holder, the writing head including a writing tip and a guiding wick;

wherein an automatic adjustment and control element is fixed within said writing holder and has a degressive capillarity distribution from a first end of said automatic adjustment and control element apart from said writing head relative to a second end adjacent to said writing head, wherein an air aperture is defined where said writing holder is adjacent to said writing head, and wherein said writing head is deeply inserted into but not through said automatic adjustment and control element.

7. The automatic adjustment and control structure for writing liquid as claimed in claim 6, wherein said automatic adjustment and control element is made of fibrous materials having good adsorbability and permeability.

8. The automatic adjustment and control structure for writing liquid as claimed in claim 6, wherein said automatic adjustment and control element is a whole or a combination, which has tiny holes or a degressive hierarchy of capillarity distribution.

9. The automatic adjustment and control structure for writing liquid as claimed in claim 6, wherein said automatic adjustment and control element serves as a partition between said adjustment portion and said storage of writing liquid.

10. The automatic adjustment and control structure for writing liquid as claimed in claim 6, wherein said automatic adjustment and control element has a plurality of channels for air or the writing liquid to pass through.

11. The automatic adjustment and control structure for writing liquid as claimed in claim 6, wherein said writing head includes a writing tip and a guiding wick.

12. The automatic adjustment and control structure for writing liquid as claimed in claim 11, wherein one end of said guiding wick is deeply inserted into but not through said automatic adjustment and control element and the other end is joined with said writing tip.

13. The automatic adjustment and control structure for writing liquid as claimed in claim 11, wherein said guiding wick and said writing tip can be integrated together.

14. The automatic adjustment and control structure for writing liquid as claimed in claim 6, wherein a mounting hole for fixing said writing head when assembly is defined in the front of said adjustment portion.

15. An automatic adjustment and control structure for writing liquid comprising:

a first unit including a storage of writing liquid; and a second unit engaging with said first unit and including an adjustment portion, an automatic adjustment and control element fixed within said adjustment portion, a writing tip and a guiding wick, wherein said automatic adjustment and control element serves as a partition between said storage of writing liquid and said adjustment portion, and has a degressive capillarity distribution from a first end of said automatic adjustment and control element adjacent to said storage of writing liquid relative to a second end adjacent to said writing tip, wherein said adjustment portion defines an air aperture, and wherein one end of said guiding wick is deeply inserted into but not through said automatic adjustment and control element and the other end is joined with said writing tip.

* * * * *